United States Patent [19]

Thibault et al.

[11] Patent Number: 5,044,884

[45] Date of Patent: Sep. 3, 1991

[54] SAFETY PROPELLER

[75] Inventors: Laurence E. Thibault, Paoli; Richard J. Pollini, Hatboro, both of Pa.

[73] Assignee: Trustees of the University of Pennsylvania, Philadelphia, Pa.

[21] Appl. No.: 403,095

[22] Filed: Sep. 5, 1989

[51] Int. Cl.[5] ..... B63H 1/16

[52] U.S. Cl. ..... 416/189; 416/247 A; 440/67; 440/71

[58] Field of Search ..... 416/244 B, 244 R, 245 A, 416/245 R, 247 R, 247 A, 93 R, 93 A, 189 R, 241 A, 194, 195, 224; 440/49, 67, 71; 403/405.1, 406.1, 407.1, 353

[56] References Cited

U.S. PATENT DOCUMENTS

| | | | |
|---|---|---|---|
| 23,598 | 4/1873 | Montgomery | 416/189 |
| 98,268 | 12/1869 | Joyner | 416/189 |
| 128,203 | 6/1872 | Aubert | 416/189 |
| 166,498 | 8/1875 | Carey | 416/189 |
| 378,221 | 2/1888 | Strong | 416/189 |
| 406,708 | 7/1889 | Daniels | 416/189 |
| 472,199 | 4/1892 | Seabury | 416/93 M X |
| 487,805 | 1/1970 | Satterthwaite et al. | 416/189 R |
| 506,572 | 10/1893 | Wagener | 416/189 |
| 512,751 | 1/1894 | Schmalte | 416/189 |
| 573,351 | 12/1896 | Parker | 416/189 |
| 677,101 | 6/1901 | Parker | 416/189 |
| 745,871 | 12/1903 | MacDuff | 416/189 |
| 855,131 | 5/1907 | Preidel | 416/189 |
| 1,067,385 | 7/1913 | Taylor | 416/189 |
| 1,092,960 | 4/1914 | Taylor | 416/189 |
| 1,228,776 | 6/1917 | Hult | 416/189 B |
| 1,438,012 | 12/1922 | Bauer | 416/189 |
| 1,467,515 | 11/1921 | Stewart | 416/189 |
| 1,518,501 | 12/1924 | Gill | 416/189 |
| 1,542,853 | 5/1924 | Callahan | 416/189 |
| 1,612,696 | 12/1926 | Beres | 416/189 |
| 1,746,145 | 2/1930 | Conway | 416/189 |
| 1,820,467 | 8/1931 | Liska | 416/244 |
| 1,910,443 | 5/1933 | Mobley | 416/189 |
| 2,091,677 | 8/1937 | Fredericks | 416/189 |
| 2,127,747 | 8/1938 | Luther | 170/170 |
| 2,213,610 | 9/1940 | Ronning | 416/189 B |
| 2,270,615 | 1/1942 | Baldwin | 170/168 |
| 2,366,795 | 1/1945 | Lamoreaux | 416/189 B X |
| 2,426,742 | 9/1947 | Pawlowski | 416/189 R |
| 3,051,250 | 8/1962 | Jones | 170/168 |
| 3,071,194 | 1/1963 | Geske | 170/156 |
| 3,148,736 | 9/1964 | Skopyk | 170/176 |
| 3,377,978 | 4/1968 | Tillman | 440/49 X |
| 4,288,223 | 9/1981 | Gonzalez et al. | 416/189 R X |
| 4,370,096 | 1/1983 | Church | 416/189 R |
| 4,832,633 | 5/1989 | Corlett | 416/241 A X |

OTHER PUBLICATIONS

L. van Gunsteren, "Ring Propellers and Their Combinations with a Stator", Marine Technology, pp. 433–448 (Oct. 1970).

*Primary Examiner*—Edward K. Look
*Assistant Examiner*—James A. Larson
*Attorney, Agent, or Firm*—Woodcock Washburn Kurtz Mackiewicz & Norris

[57] ABSTRACT

An inherently safer propeller design is disclosed. A conventional propeller has a substantially cylindrical ring affixed to the distal ends of the blades. Preferably, the leading edge of the ring extends beyond the forward most extending portion of the leading edges of the blades. The leading edge of the ring is constructed to absorb the energy of impact with an object. In this manner, damage to the object is substantially reduced. The propeller of the present invention presents a design which, in certain preferred embodiments, substantially eliminates the possibility of severe injury when a moving propeller collides with a human or animal. Preferably, the energy absorbing leading edge is comprised of a hollow sheet metal section, which may be foam-filled. Alternatively, the leading edge may be comprised of an elastomer or other material which absorbs energy. Several ways of attaching the leading edge to the ring to create a detachable and replaceable structure are disclosed. The structural advantages presented by the ring permit propellers to be designed with thinner blades, $O^1$ skew and other advantageous features not previously practical.

25 Claims, 4 Drawing Sheets

FIG.3
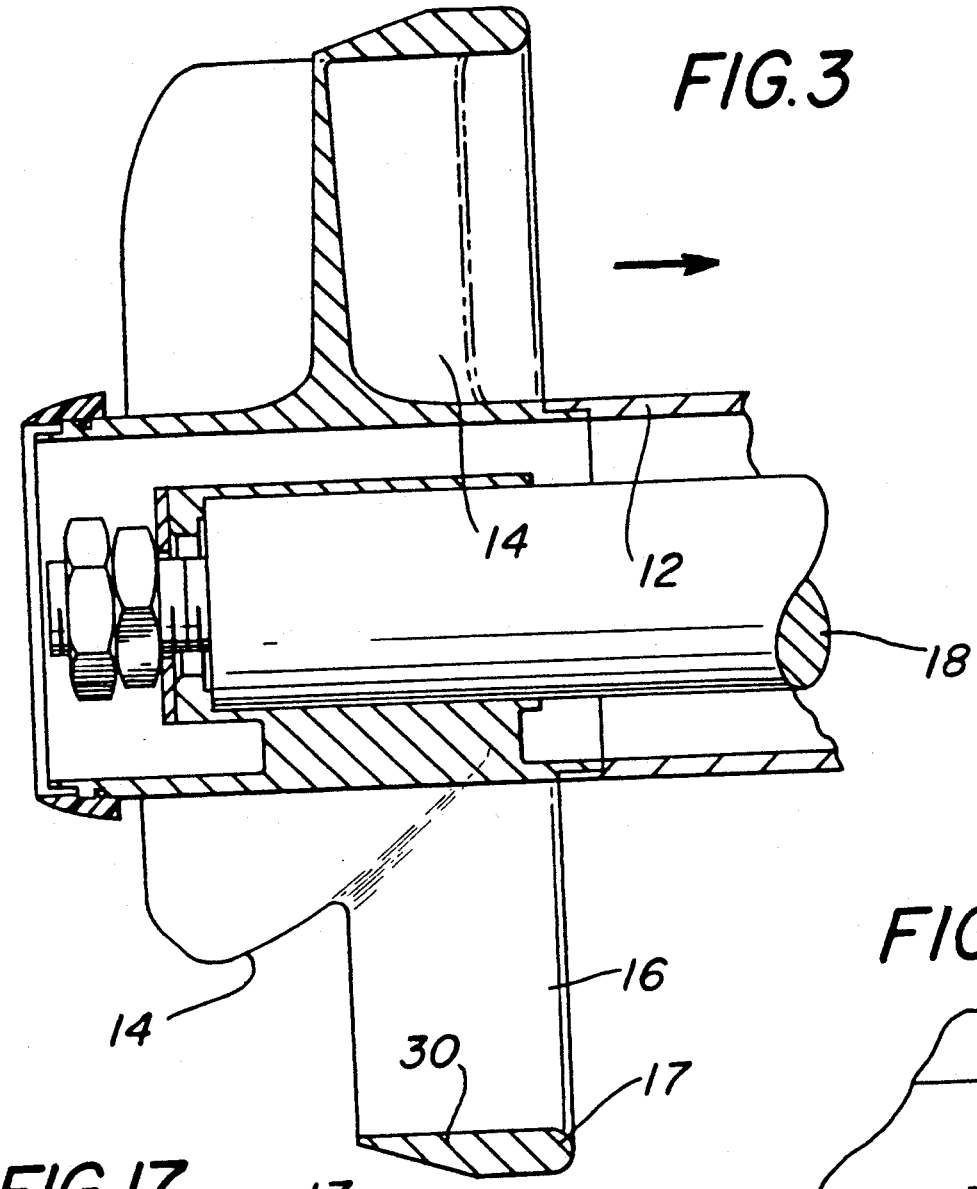
FIG.4
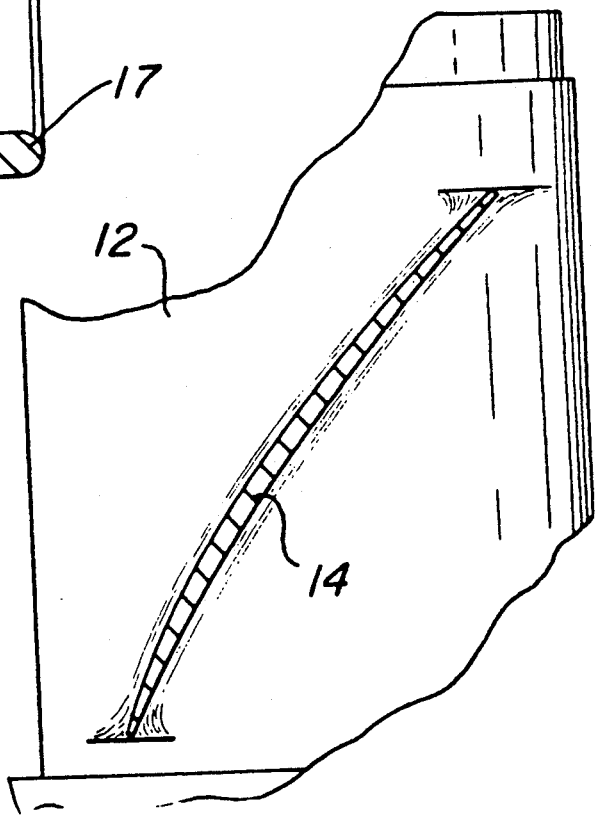
FIG.17
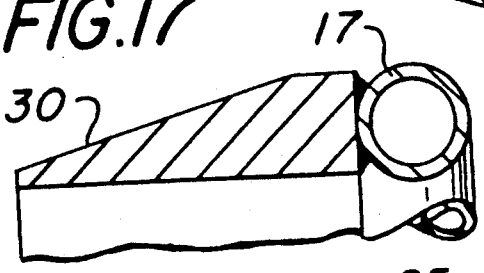
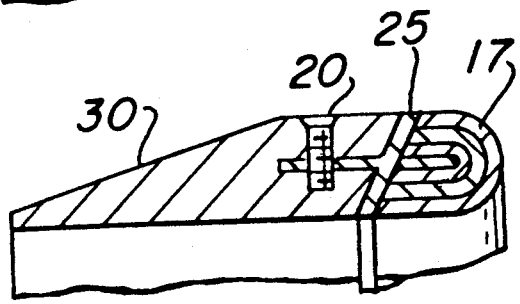
FIG.18

FIG.5
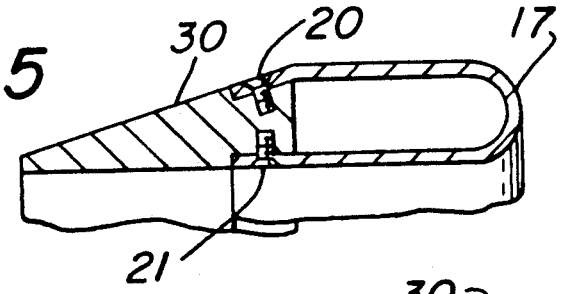
FIG.8
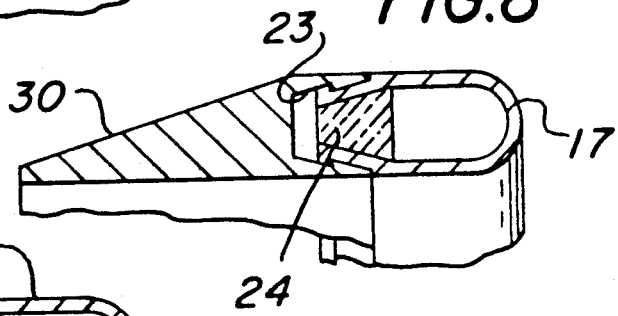
FIG.7
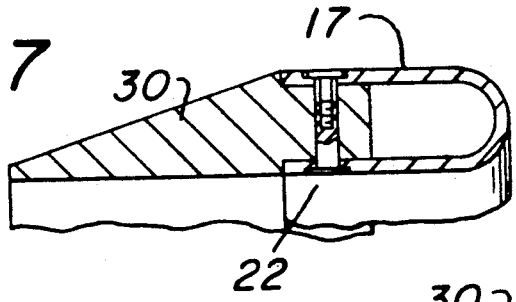
FIG.6
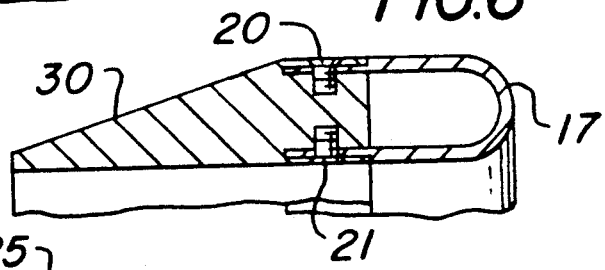
FIG.9
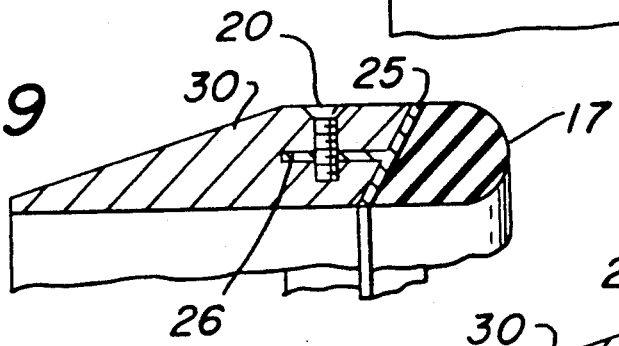
FIG.10
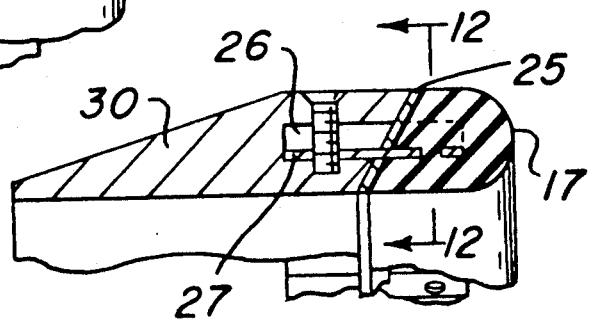
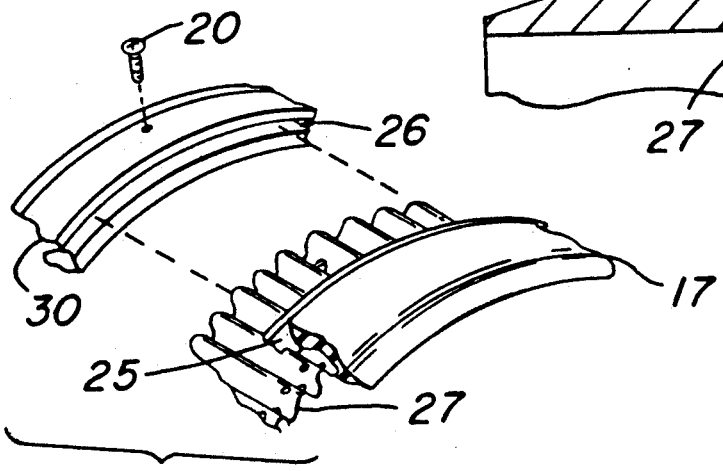
FIG.11

SAFETY PROPELLER

The present invention relates to propellers and particularly to marine propellers having improved safety aspects.

BACKGROUND OF THE INVENTION

As anyone involved in boating on either a commercial or recreational level knows, the rapidly turning propellers which provide propulsion for nearly every boat pose a constant threat of serious bodily injury. Unfortunately, no other methods or propulsion, e.g. jet propulsion, are as efficient or readily adaptable to the variety of power demands created by marine vessels.

In order to prevent the blades of a propeller from coming into contact with another object, particularly a human or an animal, a substantially cylindrical shroud can be provided. Such a shroud may be attached to the engine housing, lower drive or hull, with the propeller spinning freely therein. Alternatively, the shroud may be integral with the propeller itself and rotate alone with the propeller. This latter concept has been used to provide safer radiator fans, as found in most automobiles.

Marine propellers having a ring or a ring-like structure securely attached to its outer edges so that it spins with the propeller are known. U.S. Pat. No. 1,092,960—Taylor discloses a marine propeller having a solid annular rim encircling the blades and connected thereto at the outer edges thereof. In cross-section, the solid annular rim is symmetrically tapered, decreasing in thickness from front to rear. The Taylor patent teaches that the encircling solid rim enables the diameter of the propeller to be reduced while increasing the power.

When a ring is affixed to a conventional propeller, a phenomenon known as vortex shedding is prevented. This phenomenon occurs when, as fluid flows past an object fluid vortices are periodically shed downstream from the restricting object. The ring essentially prevents an apparent component of passive drag. By minimizing the surface area of the ring affixed to the propeller blades, vortex shedding may be substantially reduced or even eliminated.

SUMMARY OF THE INVENTION

Accordingly, it has now been found that a propeller may be provided which comprises a full circumferential shroud or ring which prevents contact with the blades of the propeller under most circumstances. Preferably, the leading edge of the ring of the propeller of the present invention can absorb the energy of impact. In a most preferred embodiment, the replaceable leading edge is a hollow sheet metal ring. The energy absorbing properties may be altered by filling the hollow space beneath the metal surface with a material such as a foam. By providing several embodiments whereby the leading edge of the shroud may be easily replaced, hydrodynamic energy management capability is incorporated into the device.

In a preferred embodiment the propeller comprises a hub means for attaching the propeller to a shaft to which a plurality of propeller blades ar attached. A substantially cylindrical ring is attached to the distal end of each of the propeller blades. Most preferably, the ring means comprises a leading edge portion extending beyond the leading edges of the propeller blades which is comprised of an energy absorber. The present invention thus permits damage to the propeller and the object to be reduced by energy being absorbed by the leading edge portion. In a most preferred embodiment, the leading edge portion extends at least about 0.75 inches beyond the leading edges of the propeller blades. The propeller design present allows the blades to have a skew angle of about 0 . In other preferred embodiments, the outer surface of the ring means tapers toward the trailing edge portion and the inner surface of the ring means is substantially flat and parallel to the centerline of the hub means.

There are two basic configurations for the energy absorbing leading edge: it may be comprised of a substantially hollow section, which may be filled with energy absorbing material, or the leading edge may be the comprised of a substantially solid section of energy absorbing material.

In certain preferred embodiments, the hollow section is formed from metal walls, such as aluminum or brass. Most preferably the metal walls are between about 0.020 and about 0.030 inches in thickness. Several embodiments for affixing the energy absorbing leading edge to the ring are disclosed. A hollow section can be affixed to the ring means by one or more fasteners, such as screws or rivets. Alternatively, the hollow section can be affixed to the ring means by mechanical means for engagement, such as a dovetail and a groove, the groove preferably disposed on the ring means and the leading edge preferably comprising a dovetail. In such an embodiment, a resilient material is preferably disposed within the substantially hollow section, creating an urging force which locks the dovetail into the slot.

Those embodiments using a solid section of energy absorber ma also be designed to permit the leading edge to be easily replaceable. A backing plate can be affixed the solid portion, and disposed in a slot in the ring means, and used in conjunction with a locking screw which engages the backing plate. Alternatively, a backing plate affixed to the solid portion and a corrugated locking plate at least partially imbedded in the solid portion ca be provided. The corrugated locking plate is then disposed in the slot in the ring and engaged by the locking screw. Finally, a propeller can be constructed which comprises a slot disposed on the ring means along with a plurality of radially aligned locking pin means disposed across the slot and at least one locking screw means. The leading edge portion is then constructed using a backing plate affixed to the solid portion which comprises a plurality of axially open, circumferentially extending slots. Upon assembly the backing plate is slidably disposed in the slot and engages by the locking pin means, and the locking screw means.

Thus, the leading edge of the propeller of the present invention may comprise either a substantially solid section comprised of energy absorbing material affixed to the leading edge section, or may be comprised of a hollow section affixed to the ring means. In most preferred embodiments, the leading edge portion is detachable and replaceable.

BRIEF DESCRIPTION OF THE DRAWINGS

FIG. 3 is a cross-sectional view, taken along lines 3—3 of FIG. 2, of the propeller of FIG. 1.

FIG. 4 is a cross-sectional view of a blade of the propeller of FIG. 1, taken along line 4—4 of FIG. 2.

FIGS. 5-10 are partial cross-sectional views of the various preferred embodiments of the outer rim of a propeller made in accordance with the present invention.

FIG. 11 is a partial perspective view of another embodiment of the outer rim of a propeller made in accordance with the present invention.

FIG. 17 illustrates partial cross-sectional view of a further embodiment of the propeller of the present invention.

FIG. 18 shows a partial cross-sectional view of another embodiment of the propeller of the present invention.

DETAILED DESCRIPTION OF THE PREFERRED EMBODIMENTS

Figure 1:
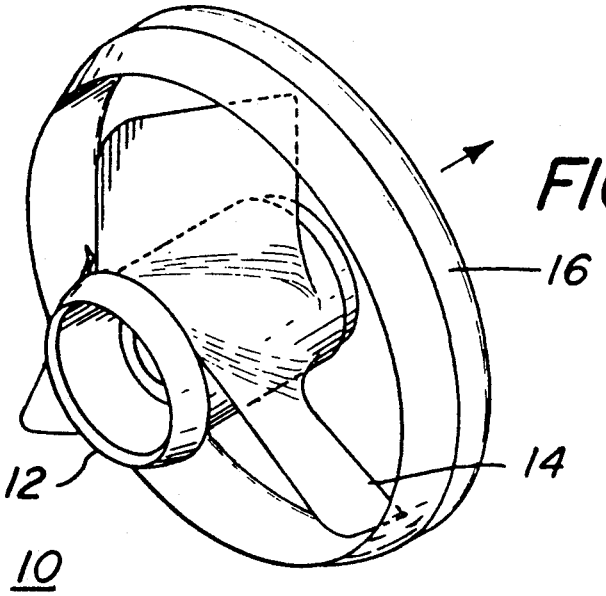
FIG. 1 is a perspective view of a propeller made in accordance with the present invention.

The device described herein is designed substantially to reduce or mitigate serious injury resulting from the collision of power boat propellers with humans or animals. The device of the present invention is not, however, merely a propeller guard, but rather presents an inherently safer and more efficient propeller design.

The present invention incorporates the concept of a rotating ring which is a integral component of the propeller in that the ring is affixed to the tips of the propeller blades. Most preferably, the device of the present invention would be cast as a single unit. Although, as pointed out above, propellers having integral rings are known, the present invention possesses numerous advantages and features which distinguishes the device of the present invention from those prior art designs.

The presence of the ring affixed to the blades presents several structural advantages which permit the blades themselves to be advantageously altered. For example, the blade skew may be altered and the blade thickness can be reduced. Most preferably a skew of 0° can be achieved. It is well known to those of ordinary skill that for most marine applications, positive propeller blade skew is undesirable. In the past, however, the stress limitations created by bladed designs presented practical limitations to reducing the skew to 0°. The ring affixed to the propeller of the present invention, however, permits 0° skew to be achieved. For this reason, the diameter of the propeller can be reduced while maintaining the same power output as compared to conventional, bladed designs.

Also, the ring affixed to the propeller of the present invention also eliminates the need for a conventional anti-ventilation plate. Such plates ar normally disposed on the lower portion of the drive unit of an outboard motor. The ring serves the same function as the anti-ventilation plate, thereby eliminating the need for that portion of the lower drive mechanism. Moreover, the structural advantages presented by the ring permit the blades to be "cupped" to further reduce ventilation.

Additionally, since the blade tips are now rigidly joined, improvements in both static and dynamic balance can be achieved. The ring provides a further structural advantage in that the blades are reinforced and thereby prevented from tearing off due to the load created by their acceleration through the fluid.

Those of ordinary skill are aware that stainless steel propellers are more efficient than those made from aluminum or plastic. The reason for this increase in efficiency is that the blades can be made thinner and therefore less surface area is presented to the fluid. As a result, drag is lowered and a higher power output is achieved. The structural advantages described above which result from the ring affixed to the propeller blades in the present invention permit aluminum blades to be made thinner and still withstand the stress of operation. Thus, an aluminum propeller made in accordance with the present invention will approach the performance of a stainless steel bladed propeller.

In certain applications, the stress reducing characteristics of the ring, when combined with the energy absorbing nose section of the present invention, permit the production of propellers from plastics or other materials on a more practical basis than conventional designs permit. As previously pointed out, the fixing of the blade tips to the ring significantly reduces blade stress, thus allowing plastic blades of hydraulically appropriate cross-section to be designed. The energy absorbing nose section, in addition to reducing injuries, also protects the plastic propeller from damage.

The hollow nose section provided in certain embodiments of the present invention, in addition to reducing the likelihood of injury, helps prevent blade damage due to solid objects such as rocks, buoys or logs. The hollow nose section will deform and absorb energy, and in many instances deflect the foreign object from the propeller.

Because the nose portion of the propeller of the present invention is hollow in certain embodiments, it is thus possible to construct a hollow leading edge within an otherwise solid ring. Most preferably, the hollow leading edge portion would comprise soft deformable alloys of aluminum or brass. As set forth in greater detail below, numerous embodiments are contemplated for attaching the leading edge of the ring to the trailing edge of the ring surrounding the propeller blades. Regardless of the attachment method used, however, it has been found that for recreational-type propellers, the optimum thickness of the nose portion is between about 20 to 30 mils (0.020 to 0.030 inches). This thickness provides sufficient energy absorbing capacity to significantly reduce injury to the human skull when the boat was moving at 30–35 mph. This is an important advancement in the safety of propellers, since it has been found that the majority of boating accidents involving collision with the propeller blades occur when the boat is travelling at speeds of less than about 20 mph.

Analysis and testing of propellers having a ring affixed to the tips of the propeller blades has shown that there is a threshold of ring width (i.e., length in the axial direction) above which drag become significant. In the context of the propeller of the present invention it is important to maximize the width of the ring to provide a maximum margin of safety. The propeller design of the present invention quantifies this relationship an determines the threshold value for maximum ring width.

As shown in FIGS. 1 and 3, the axial width of the ring 16 is less than the blade tip width (that is, the width of the blade tip as projected on a longitudinal plane), so that a portion of each blade tip extends downstream from the ring.

In order to present a safer propeller design, it is important that the leading edge of the ring extend beyond the farthest forward leading edge of the propeller blades. This permits the energy absorbing leading edge to first contact the skull, limb or other object involved in a collision, and substantially reduce injury or damage. In a most preferred embodiment, the leading edge of the ring should extend about 0.75 inches beyond the leading edge of the propeller blades.

The leading edge of the ring is preferably parabolic or semi-circular in cross-section. The exact shape of the cross-section of this region does not appear to be critical, however, it is important that the thickness of the ring itself be minimized, which will dictate the design of the leading edge accordingly. The cross-section of the ring beyond the leading edge is asymmetrical. In contrast to the tapered ring cross-sections of many prior art designs, the cross-section of the ring of the propeller of the present invention is substantially flat and parallel to the axis of the propeller on the inner surface, and tapered on the outside, the leading edge being thicker than the trailing edge.

The ring design of the present invention reduces vortex shedding, allowing the same power to be produced by a propeller having a smaller diameter than conventional designs. The reduction in diameter which can be achieved by virtue of the addition of a ring affixed to the blade tips has been shown to be about 12%. The reduction of vortex shedding also reduces the load placed upon the engine and drive mechanism, thereby extending the life of bearings and other load sensitive components. Finally, cavitation is also reduced. As a result, in operation, the propeller of the present invention creates less turbulence and results in smoother, quieter operation. Thus, a propeller blade designed in accordance with the present invention will exhibit only about an 8% loss of power compared to the same propeller without a ring.

Referring to FIG. 1, there is shown a perspective view of a propeller 10 made in accordance with the present invention. In the embodiment shown, a central hub portion 12 has three propeller blades 14 affixed to its surface. The design of the inner surface of the hub portion 12 will vary depending upon the configuration of the drive shaft to which the propeller 10 is attached. It will be understood that other propeller designs comprising two, four or more blades 14 are contemplated by the present invention, and that the embodiments shown herein are for illustrative purposes. Affixed to the distal end of each propeller blade 14 is a ring 16. The ring 16, as shown, is tapered on its outer surface.

The arrow shown in FIG. 1 illustrates the direction in which the propeller moves through the water, in other words, the direction in which the craft to which it is attached is moving. In FIG. 1 it can be seen that the forward or leading edge of the ring 16 is constructed such that it is forward of the most forward extending portion of the propeller blades 14. The leading edge 17 of the ring 16 is the thickest portion, the outer surface tapering toward the trailing edge.

Figure 2:
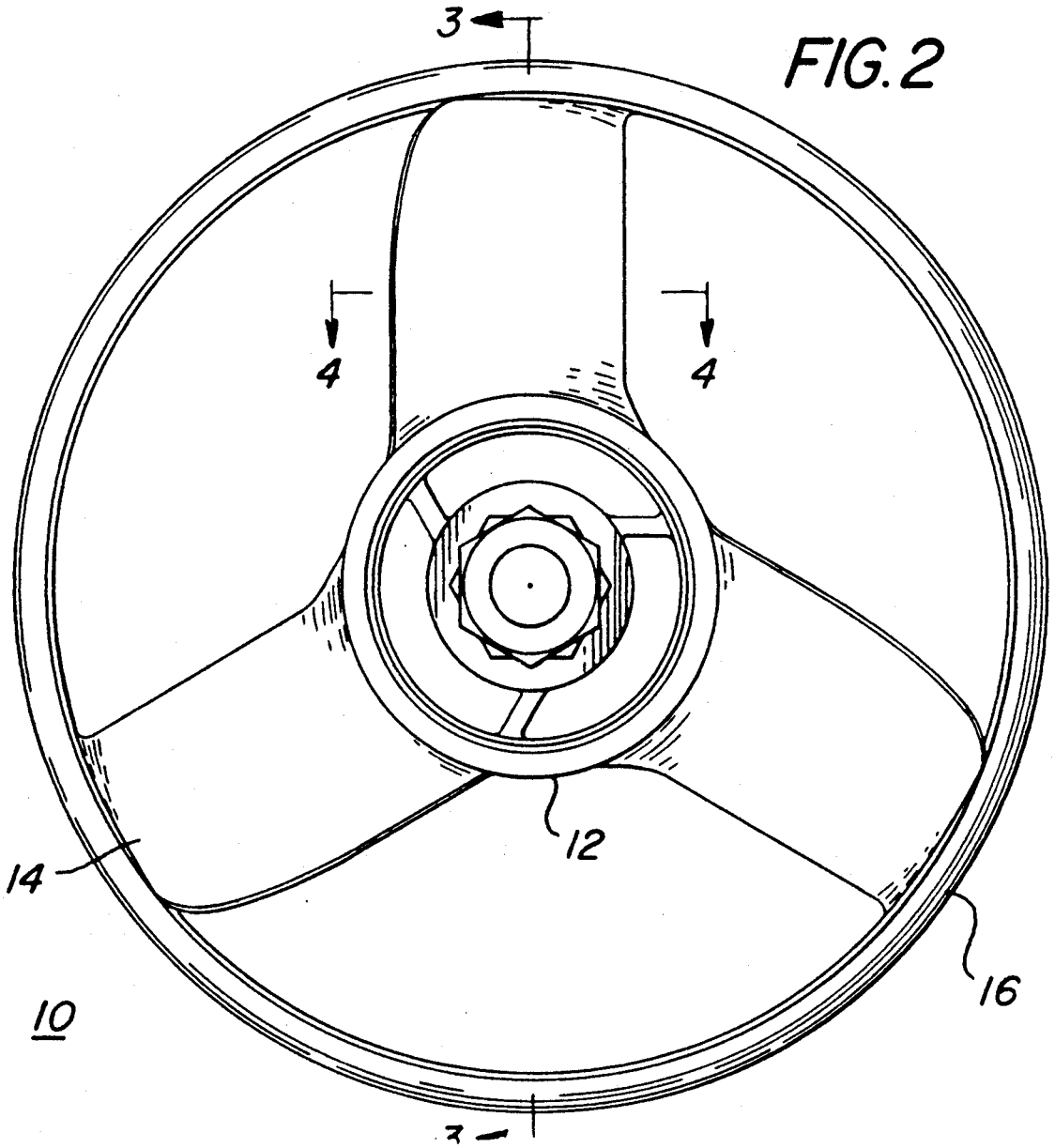
FIG. 2 is a front view of the propeller of FIG. 1.

In FIG. 2, a front view of the propeller 10 illustrated in FIG. 1 is shown. A cross-section of FIG. 2, taken through line 3—3, is shown in FIG. 3. The arrow in FIG. 3 reflects the direction of forward travel, as in FIG. 1. In cross-section, it is clearly seen that the inner surface of the ring 16 is substantially flat and parallel to the axis of the drive shaft 18 attached to the hub portion 12. From FIG. 3 it is also clear that the ring 16 is comprised of a leading edge portion 17 and a trailing edge portion 30, the leading edge portion being of a different construction than the rest of the ring 16. The different construction may entail numerous embodiments, as will be set forth below, including different materials, hollow construction or other combinations of elements.

Regardless of the form taken, it is important that the leading edge 17 of the ring 16 be designed to absorb the energy of impact. The propeller of the present invention permits the leading edge 17 to be very specifically designed to optimize this energy-absorbing characteristic. By providing a separate component for the leading edge 17, various materials, thickness and configurations can be tested for various applications to different horsepower and blade configurations.

A typical cross-section of a blade 14 is shown in FIG. 4. The cross-section was taken along line 4—4 in FIG. 2 and also shows a portion of the hub portion 12.

Figure 13:
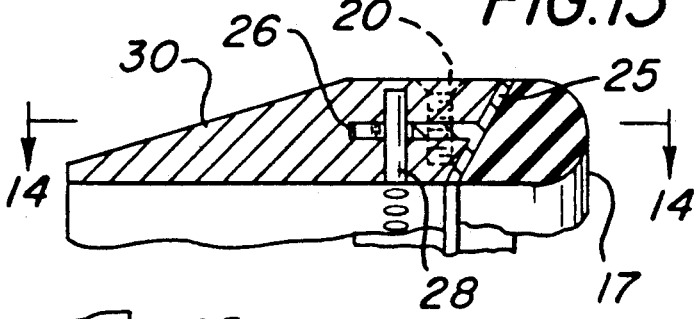
FIG. 13 depicts another partial cross-sectional view of a preferred embodiment of the propeller of the present invention.
Figure 16:
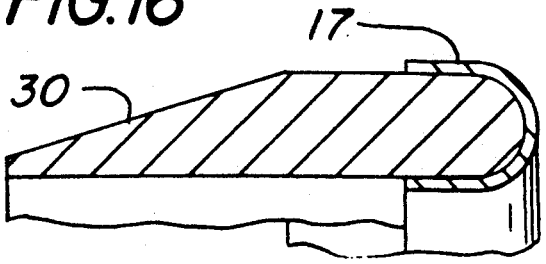
FIG. 16 shows a partial cross-sectional view of another embodiment of the propeller of the present invention.

Referring now to FIGS. 5–10, several preferred embodiments of the ring 16 assembly of the propeller of the present invention are depicted. It will be understood by reference to FIG. 3 that FIGS. 5–10, as well as FIG. 13 and FIG. 16, are all broken away cross-sectional views of a portion of the ring 16 of the propeller 10 of the present invention.

In FIG. 5, a hollow leading-edge 17 is attached to the trailing edge 30 using two screws 20,21. It is understood that a plurality of such screws 20,21 can be disposed around the circumference of the joint between the trailing edge 30 and the leading edge 17. The exact number being determined by the design parameters of the particular propeller application.

As shown in FIG. 6, in some instances it will be desirable to position the screws 20,21 which hold the energy absorbing leading edge 17 in place, directly opposite one another. Comparing the embodiments of FIGS. 5 and FIG. 6, one of ordinary skill will observe that the configuration of FIG. 5 permits the leading edge portion 17 to occupy a larger percentage of the width of ring 16. It is thus understood that for different loading conditions, design constraints or ring sizes, the length of the hollow or otherwise energy absorbing portion 17 of the ring can be adjusted accordingly.

Another method of attaching the leading edge 17 to the trailing edge 30 is shown in FIG. 7. In a configuration similar to FIG. 6, a rivet 22 is used in place of screws 20,21. One of ordinary skill will appreciate the advantages of security, weight and ease of assembly presented by using a rivet 22 in place of two screws 20,21. A disadvantage, however, lies in that when it becomes necessary to replace the ring 16, the rivets 22 must to be drilled out and replaced, requiring more labor and tooling than certain other embodiments.

In certain embodiments, hardware for attaching the energy absorbing leading edge 17 to the trailing edge 30 may be dispensed with altogether. As shown in FIG. 8, a dovetail groove 23 is machined into the forward facing surface of the trailing edge 30. The energy absorbing portion 17 is constructed to co-act with and engage the profile of the dovetail groove 23. Preferably, resilient material 24 is disposed around at least portions of the leading edge 17 substantially as shown. The resilient material urges the rear-facing edges of the leading edge into engagement with the dovetail slot 23.

To assemble a propeller made in accordance with FIG. 8, the leading edge 17 having the resilient material 24 already disposed therein is first urged rearward, past the edges of the dovetail slot until the two pieces engage. The leading edge 17 and slot 23 will engage due to the urging force provided by the resilient material 24. To replace the leading edge 17, the portion of the leading edge must first be compressed sufficiently to allow the dovetail portions to disengage, thus allowing the ring to be withdrawn. Although the embodiment of FIG. 8 presents the advantages of ease of assembly and a hydraulically "clean" surface free of protrusions, depressions or hardware, it presents a more complex set of components requiring accurate machining to be functional.

The embodiments of FIGS. 5–8 were illustrated using hollow sheet metal sections as the construction of the energy absorbing leading edge 17 of the ring 16. It will be understood however, that the interior void presented by such a construction might be filled with any of a variety of plastics, foams, elastomers, silicones or other materials in order to change the energy absorbing characteristics of the leading edge 17. In preferred embodiments substantially in accordance with any of FIGS. 5–8, the metal forming the hollow, energy absorbing leading edge 17 will be between about 0.020–0.030.

In certain embodiments it will be preferable to mold or cast the leading edge 17 from a elastomeric or other material capable of absorbing the energy of impact while minimizing damage to the object struck. As shown in FIG. 9, a simple version of such an embodiment comprises a solid leading edge portion 17 which is attached to a backing plate 25. In turn, the backing plate 25 is designed to fit into a slot 26 machined into the forward facing surface of the trailing edge 30. Disposed around the periphery of both the trailing edge 30 and the backing plate 25 are holes appropriately aligned and threaded to accept one or more screws 20 which firmly attach the energy absorbing edge 17 to the ring 16.

It is understood that the elastomer or other energy absorber may be attached to the backing plate by rivets, screws or other hardware, or by adhesives. Additionally, the energy absorber may be cast in place, and, in certain embodiments, the backing plate provided with perforations, slots, grooves, projections or other surface features to enable good adhesion between the energy absorbing material being cast in place and the backing plate 25. In certain embodiments a composite energy absorber may be used which has different energy absorbing properties in different sections of the leading edge 17 as shown in FIG. 18.. The leading edge could be built up using several layers of different materials, or the same material could be altered by processing or formulation to have different elastic properties in different sections. Also, corrugated metal or other structures can be embedded within the elastomeric section, to absorb energy and thereby fine tune the energy absorbing properties of the leading edge 17.

Figure 12:
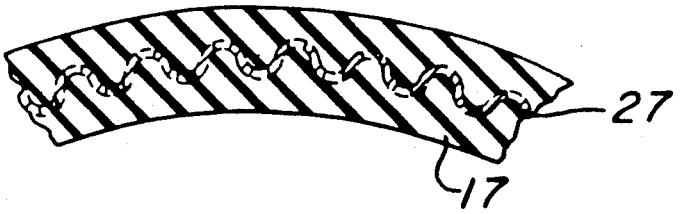
FIG. 12 is a cross-section of the outer rim, taken along lines 12—12 in FIG. 10.

A modification of the embodiment of FIG. 9 is depicted in FIGS. 10–12 As shown in FIG. 10, an elastomeric or otherwise energy absorbing leading edge 17 is again attached to a backing plate 25. However, as more clearly seen in the exploded perspective view of FIG. 11, in this embodiment, an additional corrugated locking plate 27 cooperates with both the backing plate 25 and the slot 26 disposed in the trailing edge 30 to lock the energy absorbing leading edge 17 in place. As shown in FIG. 10, the corrugated locking plate 27 extends through the backing plate 25 and is embedded in the solid portion of the leading edge 17. The backing plate 25 may be formed from two pieces, an upper piece disposed above the corrugated locking plate 27 and a lower piece disposed below the corrugated locking plate, as shown in FIG. 10.

Most preferably, the corrugated locking plate 27 is designed to be slightly compressed when assembled into the groove 26 disposed on the face of the trailing edge 30. The frictional force resulting firmly locks the leading edge 17 in place. However, one or more screws 20 may also be provided to further assure that the assembly remains in place. As shown in FIG. 12, when assembled, the corrugated locking plate 27 will be disposed within the energy absorbing portion 17. Thus, the additional stiffness provided will change the energy absorbing properties of the leading edge and must be accounted for when designing the corrugated locking plate 27 and choosing the composition of the energy absorbing material used in the leading edge 17.

Thus, the embodiment of FIGS. 10–12 is somewhat complex in design, however, the even, circumferential frictional force provided by the corrugated locking plate 27 permits the use of the other locking hardware to be minimized. The corrugations also add a component of resiliency to the assembly, increasing the energy absorbing capacity. Additionally, this embodiment should exhibit excellent vibrational characteristics due to the more continuous rather than fewer, more discrete points of attachment provided by other embodiments.

Figure 14:
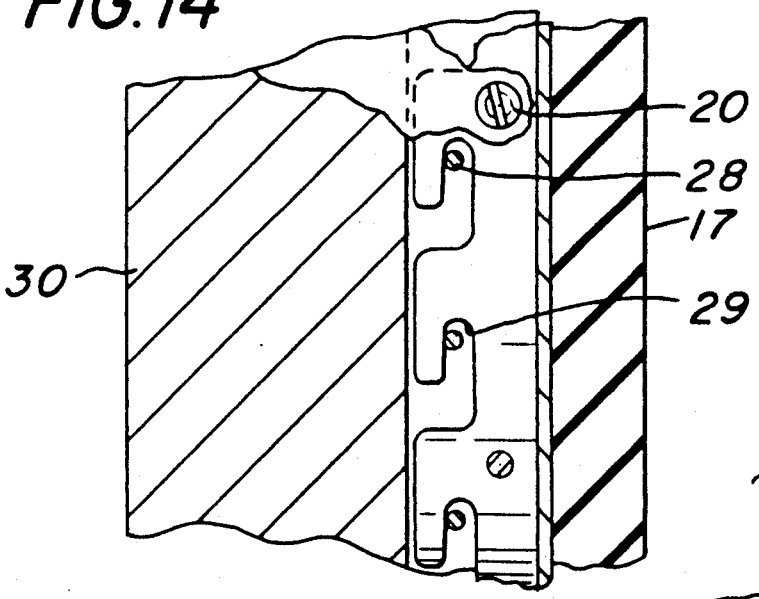
FIG. 14 is a cross-sectional view of the embodiment of FIG. 13, taken along line 14—14.
Figure 15:
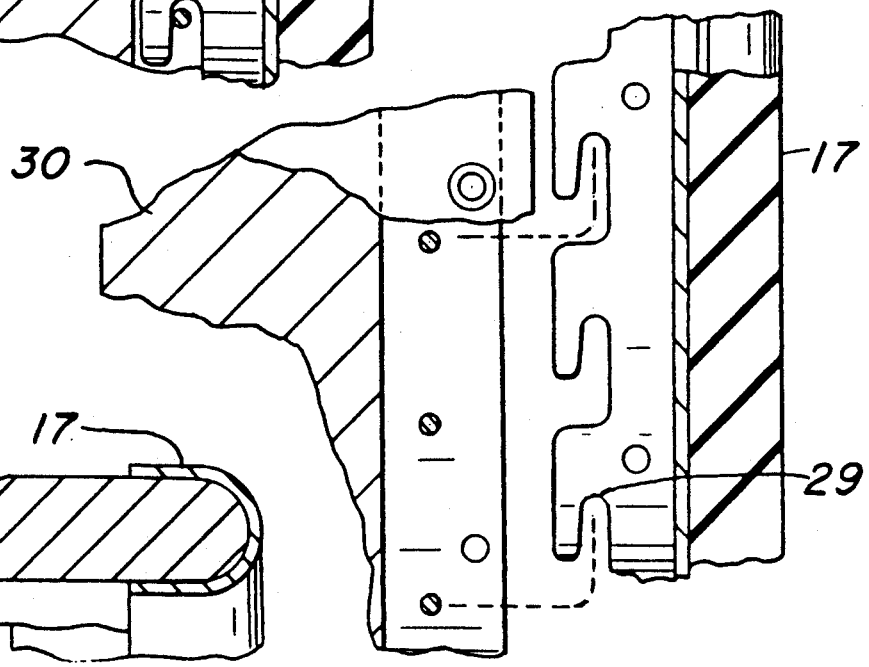
FIG. 15 is a further view of FIG. 13, similar to FIG. 14, depicting the assembly of the structural members which comprise the embodiment of FIG. 13.

Referring now to FIGS. 13–15, another embodiment of an attachment system for the replaceable, energy absorbing leading edge 17 is shown. As were the embodiments of FIGS. 9–12, this embodiment is also preferably used in conjunction with a solid elastomeric portion forming the energy absorber of the leading edge 17.

As shown in FIG. 13, the leading edge 17 is comprised of an energy absorbing portion affixed to a backing plate 25. The backing plate 25 is designed to slidably fit into a groove 26 on the face of the trailing edge 30.

The backing plate 25 is designed, as shown in FIG. 14, to comprise a series of axially open, circumferentially elongated slots 29, which engage a series of screws or pins 28 disposed in the ring 16 radially across the groove 26. As will be understood by referring to both FIGS. 14 and 15, the embodiment shown is assembled by axially inserting the backing plate 25 into the groove 26 until the elongated slots 29 are circumferentially aligned with the pins 28. The leading edge 17 is then rotated until the pins 28 are substantially in contact with or in close proximity to the closed ends of the slots 29. Upon reaching this position, holes for the locking screws 20 will be aligned, allowing the screws 20 to be driven and the assembly of the leading edge 17 completed. It will be appreciated that one or more locking screws 20 are necessary in order to prevent the leading edge 17 and ring from sliding apart during operation. The numerous connection points provided by this embodiment, and the nature of the constraint they provided, however, dictates that the number of locking screws 20 can be far less than the number of pins 28 and may be as few as one.

The embodiment depicted in FIGS. 13–15 allows the leading edge 17 to be easily and quickly replaced or exchanged. By removing the locking screws 20, the leading edge 17 may be rotated relative to the ring 16 with the relative ease and withdrawn. As with certain other embodiments, however, these advantages are obtained at the expense of higher machinery costs due to the number of components and the degree of accuracy with which they must be machined.

Several of the preceding embodiments have been of a relatively complex nature. These designs were created in order to provide an adaptable design wherein the energy absorbing leading edge could be replaced or exchanged with varying degrees of difficulty. However, the present invention encompasses numerous embodiments of a propeller 10 having a ring 16 with an energy absorbing leading edge affixed to the distal ends of the blades 14. Referring to FIG. 16, a very simple embodiment comprised of a solid ring 16 having an energy absorbing material affixed to and conforming around the front of the ring 16. This embodiment may provide a sufficient energy absorbing capacity for very low power outboard applications, such as dinghies, small inflatables and sailboats. This embodiment may also be preferred where the propeller and ring itself is comprised of an energy absorbing material, such as certain plastics.

Finally, in the interest of economy, it may be desirable to provide a propeller made in accordance with the present invention which is essentially "disposable". Referring to FIG. 17, a ring 16 is shown which has a hollow tubular leading edge portion welded to its forward face. Such an embodiment will preferably use a tube comprised of brass or aluminum and having a wall thickness of between about 0.020 and about 0.030 inches. Upon collision, the leading edge 17 will deform and the entire propeller 10 will be discarded or rebuilt only after being removed from the engine, having performed its function of absorbing the energy of the collision and preventing damage or injury to the object with which it has collided.

Although certain embodiments of the present invention have been set forth and described with particularity, the present invention is not meant to be so limited. Numerous variations, adaptations, advancements and modifications will present themselves to one of ordinary skill, being made apparent by the instant disclosure. Such further embodiments will not depart from the spirit of the invention disclosed herein. Accordingly reference should be made to the appended claims in order to ascertain the scope of the present invention.

What is claimed is:

1. In a boat propeller having a hub and a plurality of blades, each of the blades having a proximal end affixed to the hub and a distal end, each of the blades having a leading edge and a trailing edge, an apparatus for increasing the safety of the propeller, comprising:

(a) a first approximately annular member having an inner surface and an outer surface, the distal end of each of the blades affixed to the inner surface;

(b) a second approximately annular deformable member disposed upstream of the leading edges of each of the blades, the second member being substantially hollow; and (c) means for coupling and uncoupling the second member from the first member.

2. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and an outer surface, the inner surface attached to the distal end of each of the propeller blades, the ring means comprises a trailing edge portion and a leading edge portion extending beyond the leading edges of the propeller blades, wherein the outer surface of the ring means tapers toward the trailing edge portion, the inner surface of the ring means is substantially flat and substantially parallel to the centerline of the hub means, the leading edge portion has an approximately semi-circular cross-section and means for absorbing more impact energy than the trailing edge portion, whereby damage to an object as a result of a collision with the propeller is reduced by energy being absorbed by the leading edge portion.

3. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and an outer surface, the inner surface attached to the distal end of each of the propeller blades, the ring means comprises a trailing edge portion and a leading edge portion, the leading edge portion extending beyond the leading edges of the propeller blades and having means for absorbing means impact energy than the trailing edge portion, whereby damage to an object as a result of a collision with the propeller is reduced by energy being absorbed by the leading edge portion, the impact absorbing means comprises the leading edge portion being a substantially hollow section.

4. The propeller of claim 3, wherein the substantially hollow section comprises metal walls.

5. The propeller of claim 4, wherein the metal walls are comprised of aluminum.

6. The propeller of claim 4, wherein the metal walls are comprised of brass.

7. The propeller of claim 4, wherein the metal walls are between about 0.020 and about 0.030 inches in thickness.

8. The propeller of claim 3, wherein the hollow section is affixed to the trailing edge portion by one or more fasteners.

9. The propeller of claim 8, wherein the fasteners are screws.

10. The propeller of claim 9, wherein the screws are axially aligned.

11. The propeller of claim 8, wherein the fasteners are rivets.

12. The propeller of claim 3, wherein the hollow section is affixed to the trailing edge portion by mechanical means for engagement.

13. The propeller of claim 12, wherein the mechanical means for engagement comprises a dovetail and a groove.

14. The propeller of claim 13, wherein the groove is disposed on the trailing edge portion and the leading edge portion comprises a dovetail.

15. The propeller of claim 14, wherein the leading edge portion further comprises a resilient material disposed within the substantially hollow section, whereby an urging force is created which locks the dovetail into the groove.

16. The propeller of claim 3 wherein the substantially hollow section is affixed to the trailing edge portion by welding.

17. The propeller of claim 16, wherein the substantially hollow section is comprised of a substantially cylindrical tube, formed into a substantially toroidal structure.

18. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and an outer surface, the inner surface attached to the distal end of each of the propeller blades, the ring means comprises a trailing edge portion and a leading edge portion, the leading edge portion extending beyond the leading edges of the propeller blades and having means for absorbing more impact energy than the trailing edge portion, whereby damage to an object as a result of a collision with the propeller is reduced by energy being absorbed by the leading edge portion, the impact absorbing means comprises the leading edge portion being filled with energy absorbing material.

19. Propeller apparatus comprising:

(a) hub mans for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and a outer surface, the inner surface attached to the distal end of each of the propeller blades, wherein the ring means comprises a trailing edge portion and a leading edge portion extending beyond the leading edges of the propeller blades, the leading edge portion being a substantially hollow section which has been filled with an energy absorbing foam material, whereby damage to an object as a result of a collision with the propeller is reduced by energy being absorbed by the leading edge portion.

20. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and an outer surface, the inner surface attached to the distal end of each of the propeller blades, the ring means comprises a trailing edge portion and a leading edge portion extending beyond the leading edges of the propeller blades and having means for absorbing more impact energy than the trailing edge portion, whereby damage to an object as a result of a collision with the propeller is reduced by energy being absorbed by the leading edge portion, the leading edge portion comprising a substantially solid section comprised of an energy absorbing composite having different energy absorbing properties in different sections of the leading edge.

21. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and an outer surface, the inner surface attached to the distal end of each of the propeller blades, the ring means comprises a trailing edge portion and a leading edge portion extending beyond the leading edges of the propeller blades and having means for absorbing more impact energy than the trailing edge portion, whereby damage to an object as a result of a collision with the propeller is reduced by energy being absorbed by the leading edge portion, the leading edge portion comprising a layer of energy absorbing material.

22. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and an outer surface, the inner surface attached to the distal end of each of the propeller blades, the ring means comprises a trailing edge portion and a leading edge portion extending beyond the leading edges of the propeller blades and having means for absorbing more impact energy than the trailing edge portion, whereby damage to an object as a result of a collision with the propeller is reduced by energy being absorbed by the leading edge portion, the impact absorbing means comprising the leading edge portion being a substantially solid section, the leading edge portion further comprising a backing plate affixed to the solid section, the backing plate being disposed in a slot, the slot being disposed in the trailing edge portion, and the propeller further comprising a locking screw which engages the backing plate.

23. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) A substantially cylindrical ring means having an inner surface and an outer surface, the inner surface attached to the distal end of each of the propeller blades, the ring means comprises a trailing edge portion and a leading edge portion extending beyond the leading edges of the propeller blades and having means for absorbing more impact energy than the trailing edge portion, whereby damage to an object as a result of a collision with the propeller is reduced by energy being absorbed by the leading edge portion, the impact absorbing means comprising the leading edge portion being a substantially solid section, a slot disposed on the trailing edge portion; and at least one locking screw means; wherein the leading edge portion further comprises a backing plate affixed to the solid section; and a corrugated locking plate at least partially imbedded in the solid section, whereby, the corrugated locking plate is disposed in the slot and engaged by the locking screw.

24. Propeller apparatus comprising:

(a) hub means for attaching the propeller to a shaft;

(b) a plurality of propeller blades having a distal end and a proximal end, the proximal end attached to the hub means, the propeller blades each further having a leading edge and a trailing edge;

(c) a substantially cylindrical ring means having an inner surface and an outer surface, the inner surface attached to the distal end of each of the propeller blades, the ring means comprises a trailing edge portion and a leading edge portion extending beyond the leading edges of the propeller blades and having means for absorbing more impact energy than the trailing edge portion, whereby damage to an object as a result of a collision with the propeller is reduced by energy being absorbed by the leading edge portion, a slot disposed on the trailing edge portion; a plurality of radially aligned locking pin means disposed across the slot; and at least one locking screw means; wherein the leading edge portion further comprises a substantially solid section and a backing plate affixed to the solid section; the backing plate comprising a plurality of axially open, circumferentially extending slots; whereby the backing plate is slidably disposed in the slot and engaged by the locking pin means and the locking screw means.

25. A boat propeller comprising:

(a) a hub;

(b) a plurality of blades having proximal and distal ends, each of the blades having a leading edge and a trailing edge, each of the proximal ends affixed to the hub, each of the blades having an approximately 0° skew;

(c) an annular member having an inner surface and an outer surface, a first portion of the distal end of each of the blades affixed to the inner surface, the radial thickness of the annular member tapering in the axial direction, the diameter of the inner surface being essentially uniform and all of the tapering of the radial thickness of the annular member being accomplished by reducing the diameter of the outer surface;

(d) the axial width of the annular member being less than the axial width of the blades, whereby a second portion of the distal end of each of the blades extends axially downstream from the annular member.

* * * * *